United States Patent [19]

Tai-Seng

[11] Patent Number: 4,838,061

[45] Date of Patent: Jun. 13, 1989

[54] LOCK SET PROOF AGAINST PRIZE UP

[76] Inventor: Taw Tai-Seng, No. 20, Lane 43, Hansheng E. Rd., Pan Chiao City, Taipei Hsien, Taiwan

[21] Appl. No.: 118,202

[22] Filed: Nov. 6, 1987

[51] Int. Cl.[4] ..... E05B 27/04; E05B 63/00

[52] U.S. Cl. ..... 70/493; 70/395; 70/409; 70/419

[58] Field of Search ..... 70/364 A, 364 R, 358, 70/416, 419, 421, 395, 402, 405, 406, 409

[56] References Cited

U.S. PATENT DOCUMENTS

| | | | |
|---|---|---|---|
| 2,491,337 | 12/1949 | Segal | 70/419 |
| 3,267,707 | 8/1966 | Adams | 70/395 |
| 3,959,997 | 6/1976 | Williams | 70/419 |
| 4,031,730 | 6/1977 | Kern | 70/419 |
| 4,104,898 | 8/1978 | Fois | 70/419 |

*Primary Examiner*—Robert L. Wolfe

*Attorney, Agent, or Firm*—Asian Pacific Int'l Patent and Trademark Office

[57] ABSTRACT

A lock with hidden pins which is characterized by an outer sleeve, a pivot in the inner sleeve, a short tube, and an outer covering for the outer sleeve. The keyhole is positioned in the pivot, and the short tube and the pivot can be aligned. The head and the stem of the key can be disassembled.

2 Claims, 5 Drawing Sheets

LOCK SET PROOF AGAINST PRIZE UP

BACKGROUND OF THE INVENTION

For a long time the lock has acted as a safeguard to protect property and people. But the tools for lock picking that intruders and thieves use are becoming more and more effective so that the conventional locks can not stop thieves from entering houses and causing a serious menace to lives and property. The keyhole conventional lock can be violated to pry the pins to an open position in order that the lock is opened easily.

SUMMARY OF THE INVENTION

The present inventor provides a lock which is protected against prying open, and it is characterised by a keyhole in which the pins cannot to be seen when the keyhole is empty. When a key opens the lock, the keyhole will rotate to allow access to the pins, enabling each pin to be propped into position in order to cause the lock to open.

In contrast to the conventional lock set, the structure of the present lock and key is different. The key of the present invention is separative, that is, the head and the stem of the key of the present invention can be disassembled.

The present invention relates to a lock set protected against prying open, and more particularly, a lock with hidden pins. It comprises: an outer sleeve, an inner sleeve, and a pivot. A short tube having a keyhole-shaped groove or aperture is positioned inside of the pivot; convex teeth are positioned at the front surface of the pivot. Teeth are also positioned at the short tube with the keyhole, to matchingly engage with the teeth at the front surface of the pivot. Turning of the inner sleeve can drive the respective lock strip to move. Several small holes for respective pins are positioned on the inner sleeve, while a hole is positioned at the front surface of the outer sleeve. This can be in the form of an ellipse. Furthermore, several holes for pins and springs are positioned on the outer sleeve. The short tube extends from the front surface of the pivot, the pivot is positioned inside of the inner sleeve, and the inner sleeve, in turn, is positioned inside of the outer sleeve. Also the short tube extends, with its front end from the hole of the outer sleeve. can be inserted into the short tube. The key has a head and a stem which can be disassembled. The key can drive the short tube, with the head of the key serving to guide the pivot to rotate and enabling the assembly to move the position of the pins and to cause the lock to open.

DETAILED DESCRIPTION

Figure 1:
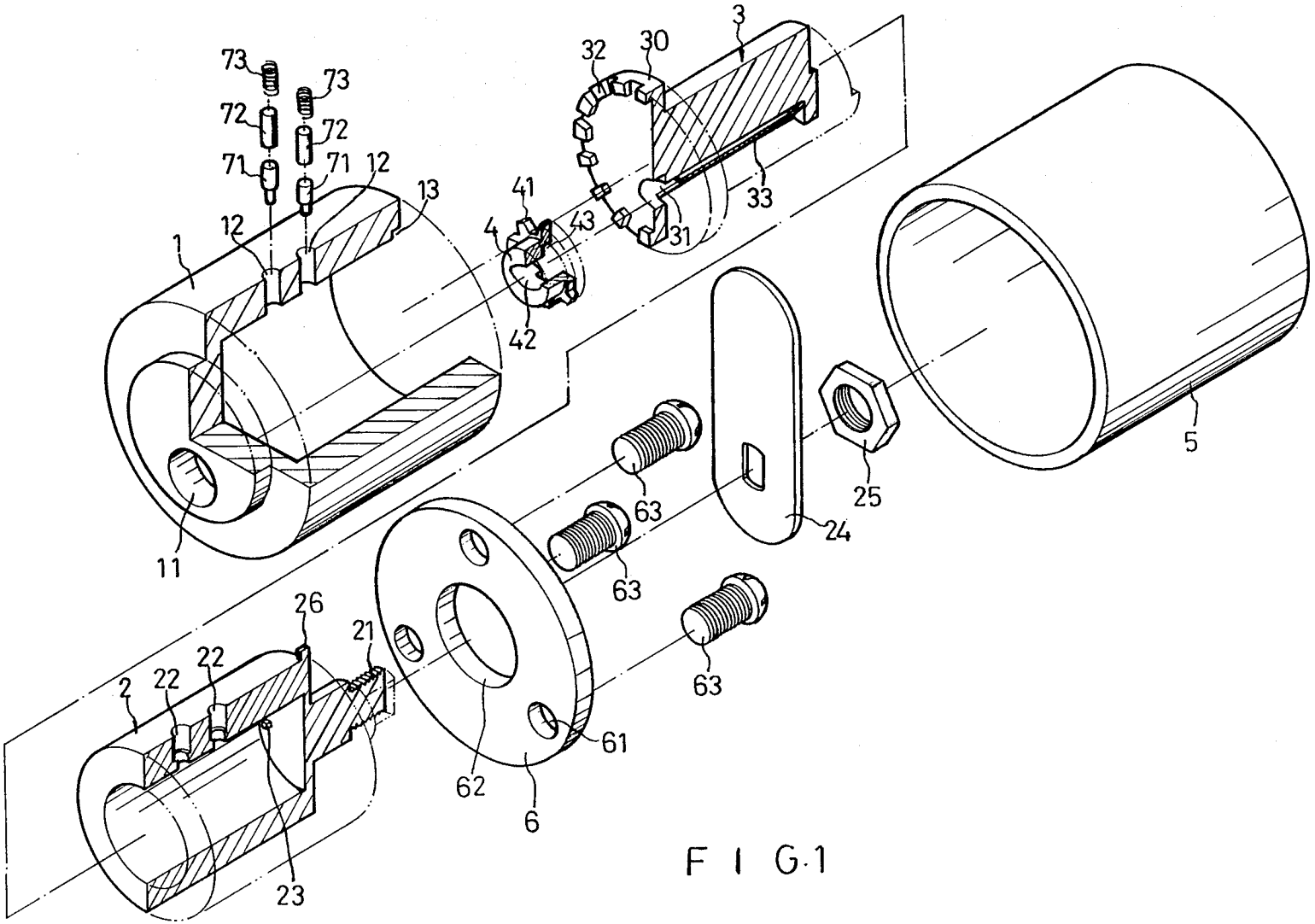
FIG. 1 is an exploded perspective view showing the lock of the present invention.
Figure 2:
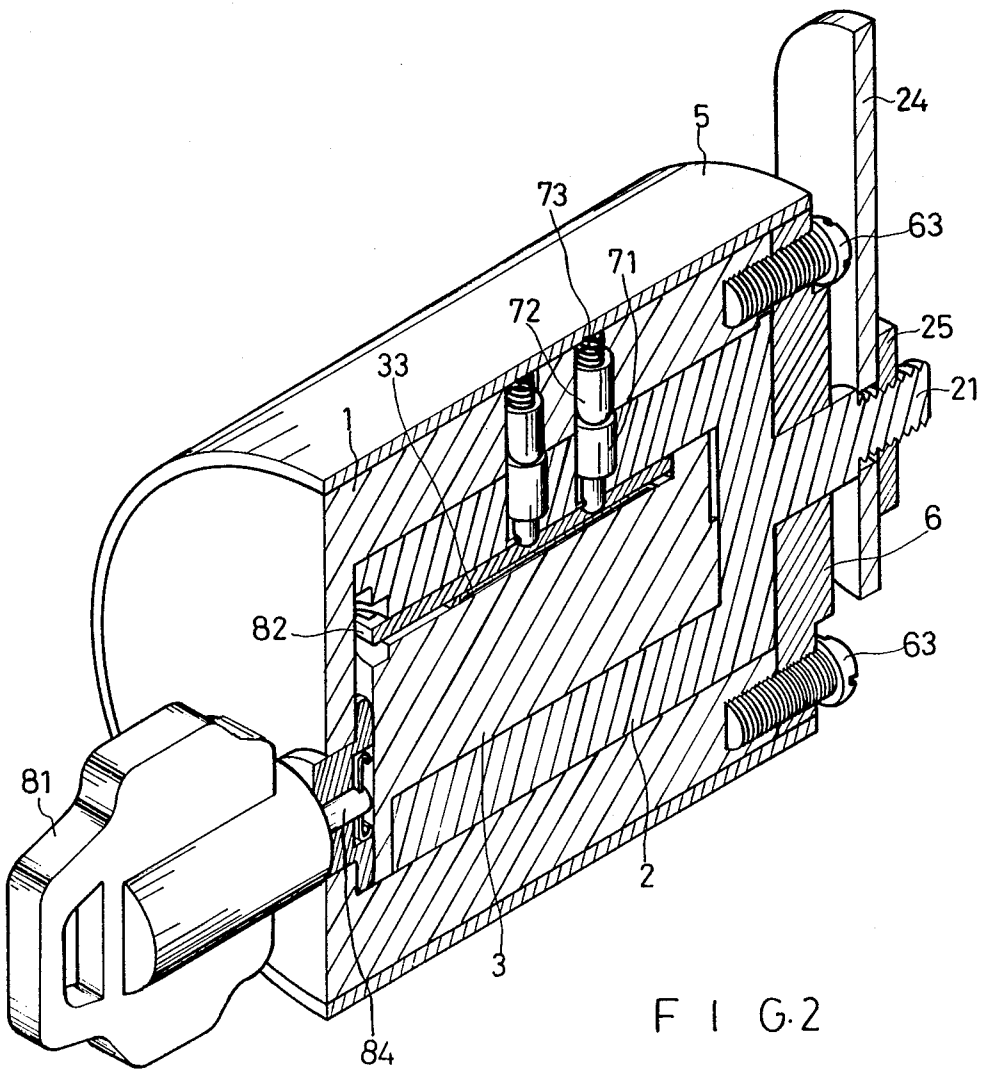
FIG. 2 is a perspective view in cross-section of the lock and key assembly of the present invention.

With reference to FIGS. 1 and 2, the lock of the present invention comprises an outer sleeve 1, a short tube 4, a pivot 3, an inner sleeve 2, a outer covering or sleeve 5, and a base plate 6.

Figure 5:
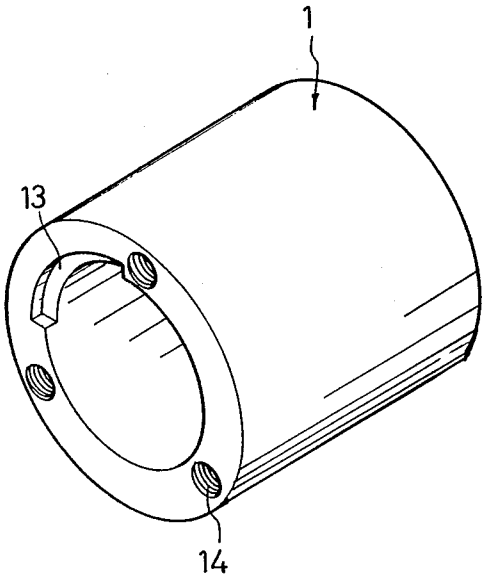
FIG. 5 is a perspective view of the outer sleeve.
Figure 4:
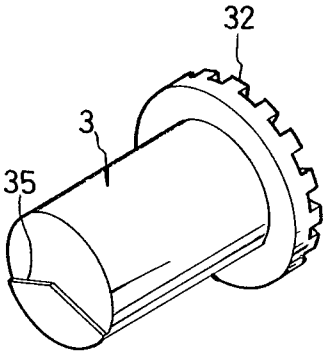
FIG. 4 is a perspective view (rear) of the pivot.

A hole 11 is positioned eccentrically at the front of the outer sleeve 1. Hole 11 can be shaped in the form of an ellipse. As shown in FIG. 5, three congruent screw holes 14 and a groove 13 are positioned at the rear of sleeve 1. Groove 13 is positioned at the inner edge of the rear of the sleeve 1. Two holes 12 are provided in the outer sleeve 1 for springs 73 and upper pins 72. The holes 12 are positioned perpendicular to the longitudinal axis of the hole 11.

Two matching holes 22 are positioned on the inner sleeve 2 for lower pins 71, and a projecting stub or axis 21 is connected at the rearward end of the sleeve 2. The axis 21 can engage a strip 24 which is fixed to the sleeve 2 by a nut 25. A convex or projecting formation 26 is positioned at the edge on the back or rear end of the inner sleeve 2, and a convex point 23 is positioned at the interior bottom of the inner sleeve 2.

Figure 3:
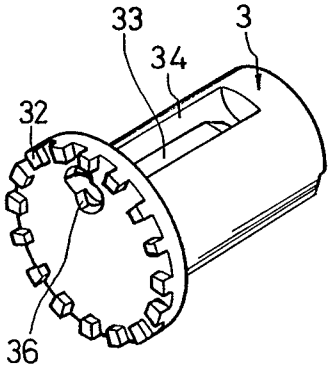
FIG. 3 is a perspective view (front) of the pivot.

The front end of the pivot 3 has a plate 30 with teeth 32, while a keyhole 31 is eccentrically positioned at the pivot 3, as shown in FIGS. 1 and 3. The pivot 3 has a groove 34 to match keyhole 31. An elastic strip 33 is positioned inside of the keyhole 31; and the back end of the pivot 3 has a concave and convex surface cam formation 35.

Figure 6:
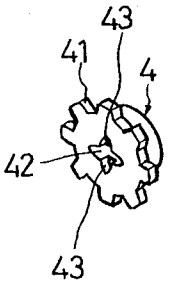
FIG. 6 is of the short tube.

Teeth 41 are positioned peripherally at the back end of the short tube 4 with a keyhole 42 being positioned at the center, as shown in FIG. 6, and two concave formations 43 (as shown in FIG. 6).

The outer covering 5 is fixed outside of the outer sleeve 1, for retention of the springs 73 and pins 71 and 72.

A hole 62 is positioned at the center of base plate 6, which also has three holes which are equally positioned at the edge to match the holes 14 of the sleeve 1.

Assembly is as follows: first, the pivot 3 is placed into the inner sleeve 2, such that the edge of the plate 30 at the front end of the pivot 3 abuts at the rearward edge of the inner sleeve 2. The keyhole 42 at the center of the short tube 4 is aligned with the keyhole 31 of the pivot 3, and the teeth 41 of the short tube 4 are matched with the teeth 32 of the plate 30 at the front end of the pivot 3. Then, position the outer sleeve 1 about the inner sleeve 2, and have the front end of the short tube 4 extend from the hole 11 at the front end of the outer sleeve 1. Also align each hole 12 of outer sleeve 1 respectively with each hole 22 of inner sleeve 2. Next, the upper and lower pins 71 and 72 and the springs 73 can be positioned in the holes 12 and 22. In the operative condition of the lock, parts of lower pins 71 and 72 extend into the holes 12 of the outer sleeve. The outer covering 5 for the outer sleeve 1 closes the holes 12 in the outer sleeve 1 and precludes the upper pins 71, the lower pins 72 and the springs 73 from coming loose. Then one can secure the base plate 6, and the axis 21 of the inner sleeve 2 is passing through the hole 62 at the center of the bottom to the base plate 6. The three screws 63 are passed through the three holes 61 of the base plate 6 and screwed into the holes 14 at the bottom of the outer sleeve 1. Then one can fix the strip 24 on the axis 21 of the inner sleeve 2 with the nut 25.

Figure 8:
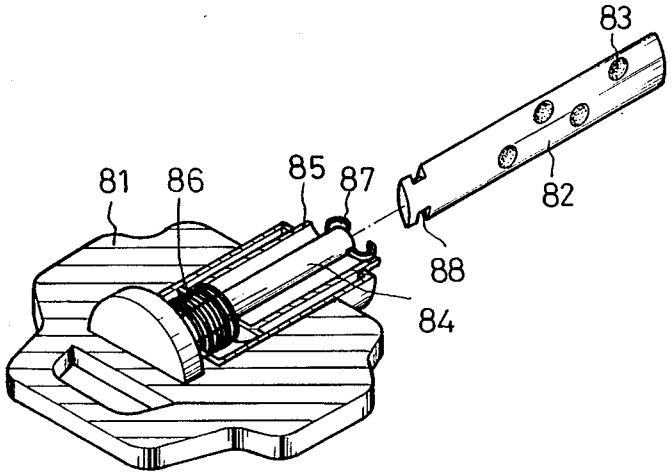
FIG. 8 is an exploded perspective view of the head and the stem of the key.
Figure 7:
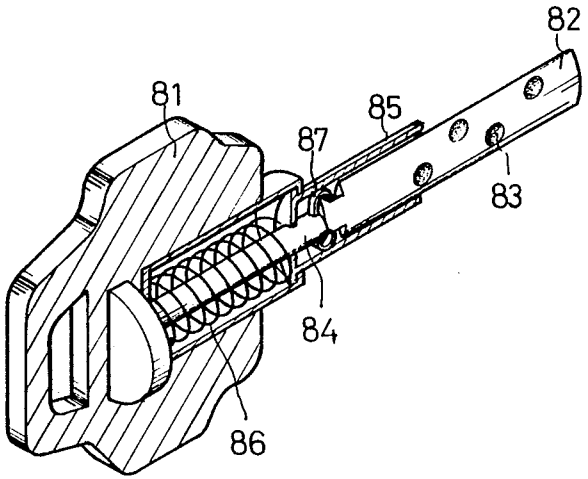
FIG. 7 is a perspective view of the assembled key of the present invention.

The key of the present invention is separative, that is, the head and the sten of the key can be disassembled or re-assembled. As shown in FIGS. 7 and 8, a buckle rod 84 is positioned at the head 81 of the key; and several depressions 83 are positioned at the front end of the stem 82. The stem 82 has a hook 87 to attach to the buckle rod 34. A sleeve tube 85 is positioned at the head 81 of the key, the inner diameter of the sleeve tube 85 should be that as the outer diameter of the stem 82, and the sleeve tube 85 can contain the stem 82, in order to preclude the stem 82 from separating from the head 81. The sleeve tube 85 is serves to actuate a compression spring 86. To disassemble the head 81 and the stem 82 of the key, one can actuate the sleeve tube 85, to compress the spring 86 until the sleeve tube 85 clears the buckle rod 84. Then rotate the stem 82 through 90° with respect to head 81 of the key; and the hook 87 at the end of the buckle rod 84 can be dislodged from the formations 88 at the front end of the stem 82, and the head 81 and the stem 82 of the key are easily disassembled in the manner.

Figure 10:
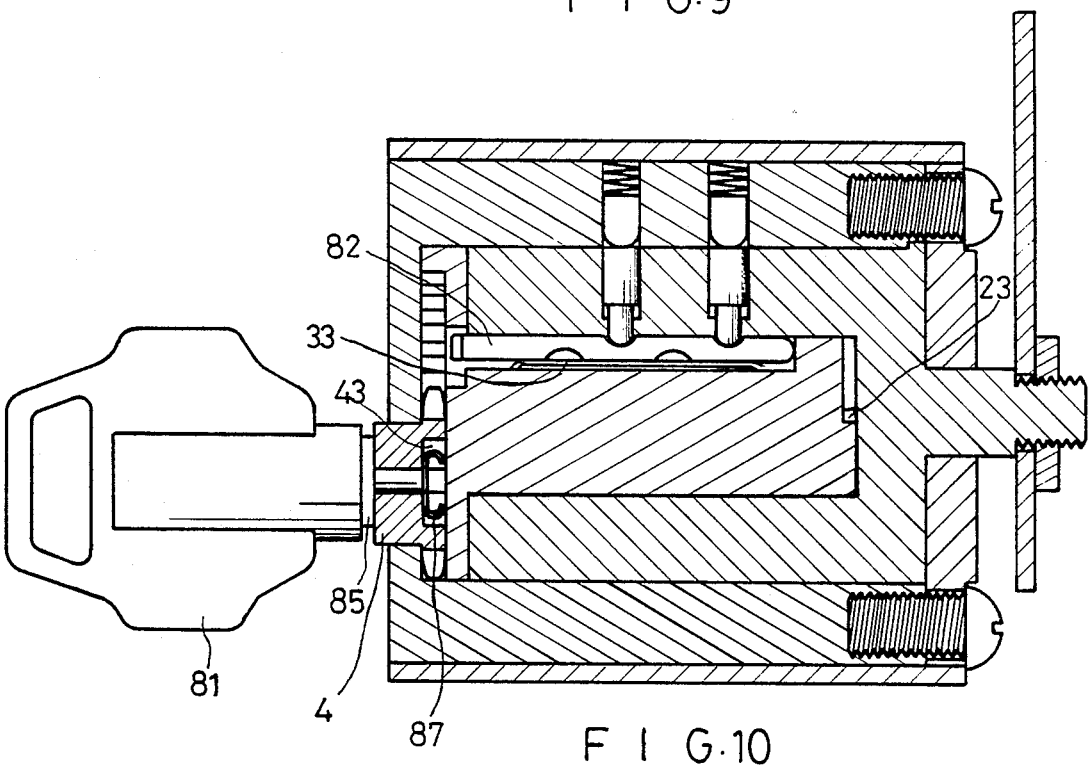
FIG. 10 is a cross-section with the pins contacting the stem of the key.

With reference to FIGS. 1 and 6 two concave depressions 43 at the bottom of the short tube 4 and perpendicular to the keyhole 42, enable the hook 87 at the end of the buckle rod 84 on the head 81 of the key to be hidden in the said two concave formations 43, as shown in FIG. 10. Two opposite gaps or formations 36 (FIG. 3) more than 90° apart are positioned at the front end on the keyhole 31 of the pivot 3, so that the buckle rod 84 at the head 81 of the key can be rotated through 90° in the said two gaps 36, and enable the head 81 and the stem 82 of the key to be disassembled.

Figure 9:
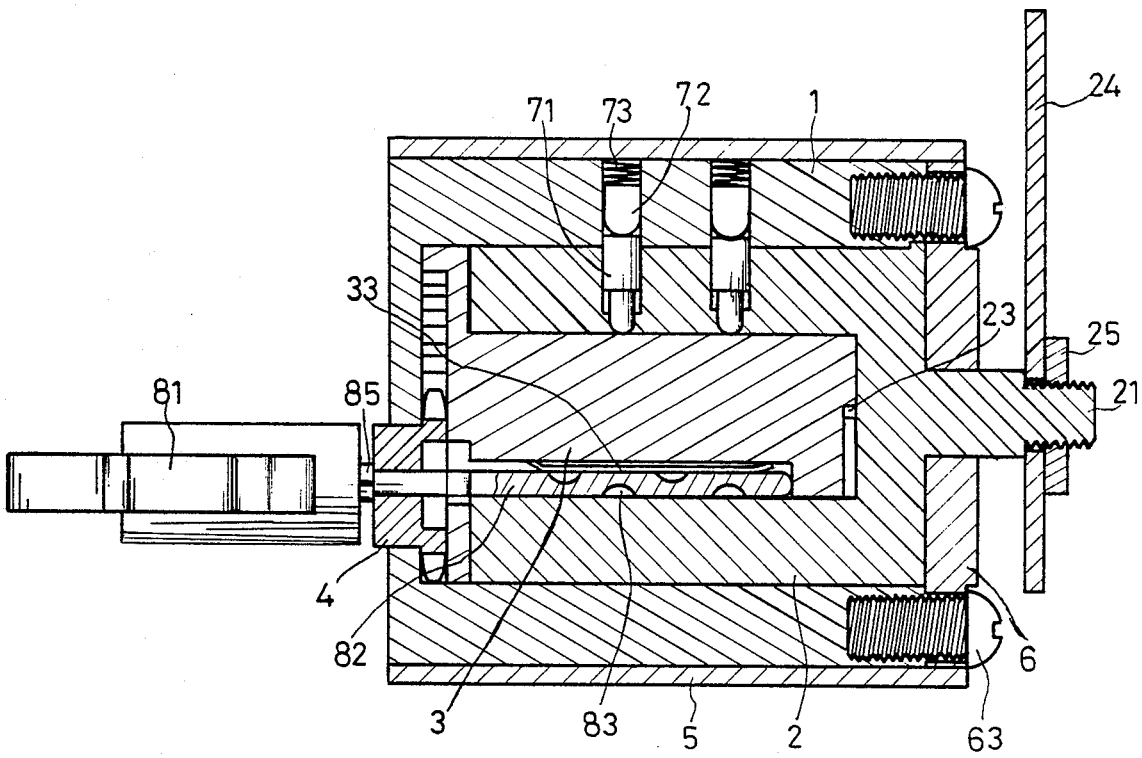
FIG. 9 is a cross-section with the key inserted into the keyhole.

In the stem 82 of a proper key must be inserted into the heyhole 31 of the pivot 3. The keyhole 42 at the center of the short tube 4 must be aligned with the keyhole 31 of the pivot 3 before the stem 82 of the key is inserted. Then the stem 82 of the key can be inserted in the keyhole 31 through the keyhole 42, but the sleeve tube 85 at the head 81 of the key can not be inserted in the lockhole 42 and carry out its compression function because of the greater outer diameter; as shown in FIG. 9. Then, the head 81 of the key is rotated through 90° and the head 81 and the stem 82 of the key are separated. Then head 81 of the key is removed from the keyhole 42 due to the force exerted by the spring 86 at the back end of sleeve tube 85, while the hooks 87 at the front end of the buckle rod 84 on the head 81 of the key are retained in the two concaves 43 inside of the short tube 4. When the head 81 of the key is rotated, the short tube 4 can be driven to rotate, and the short tube 4 can drive the pivot 3 to rotate. When the pivot 3 rotates through 180° its groove 34 is aimed at the holes 12 and 22 the upper and lower pins 71 and 72. Meanwhile, the cam formation 35 at the back end of the pivot 3 can contact the convex 23 at the bottom inside of the sleeve tube 2. The concave formations 83 of the stem 82 of the key enable each contact end of the upper and lower pins 71 and 72 to be at the interface of the outer sleeve tube 1 and the inner sleeve tube 2, as shown in FIG. 10; then the head 81 of the key can be rotated again, to enable the short tube 4 to drive the pivot 3 in rotating movement, such that the cam formation 35 at the bottom of the pivot 3 can push the convex 23 at the bottom inside of the inner sleeve tube 2, to enable rotation of the inner sleeve tube 2, and the lock strip 24 also rotates and will the lock (not shown in the figure). The convex 26 at the end of the inner sleeve 2 can be moved in the groove 13 at the bottom of the outer sleeve tube 1, and the length of the groove 13 can limit the rotating angle of the inner sleeve tube 2. After the lock is opened, connect the head 81 and the stem 82 of the key, and pull the stem 82 from the keyhole 31.

When a thief want to prize the present invention, the lockhole 42 of the short tube 4 has to be aimed at the keyhole 31 of the pivot 3, then the pins 71 and 72 in the keyhole 31 have to be moved a tool, but when the keyhole 31 of the present invention can be seen, the pins cannot be accessed and a thief cannot readily pry open the lock of the present invention which can provide enhanced safety, accordingly. Some thieves may destroy the keyhole 31 and open the lock by an electric drill, so the outer sleeve tube 1 can be made of hardened material, and one can make the front end of the outer sleeve 1 to be thicker, and this also can prevent the lock to be destroyed.

Consequently, the most important difference between the present invention and the conventional lock is that the pins can not be seen, and the thief can not move the pins, whereby the main purpose of security is achieved with certainty.

I claim:

1. A tamper-proof lock, comprising, in combination:

an outer sleeve, said outer sleeve having a groove formation, an aperture for mounting a respective short tube in said outer sleeve, and radially extending holes for respective tumbler pins;

a hollow inner sleeve positioned in said outer sleeve, said inner sleeve having radially extending holes for respective tumbler pins, said inner sleeve including an exteriorly projecting formation adapted to cooperatingly engage said groove formation of said outer sleeve, and said inner sleeve including an interiorly projecting formation;

a lock strip operatively connected to said inner sleeve;

a pivot mounted in said hollow inner sleeve, said pivot having a cam formation terminus for cooperation with said interiorly projection formation of said hollow inner sleeve, said pivot having a plate terminus remote from said cam terminus, and said pivot including a keyhole formation;

first teeth arranged in a circular pattern on said plate terminus to axially project at a diameter which is greater than the outer diameter of said pivot;

a short tube mounted in said outer sleeve, said short tube having a central keyhole formation and a set of second teeth to rotate said pivot by meshingly engaging said first teeth of said pivot;

tumbler pins adapted to be positioned in said radially extending holes of said outer sleeve and said inner sleeve, and said tumbler pins being spring biassed by respective spring;

a spring for each tumbler pin;

a key, said key having a key head and a key stem releasably secured at said key head by means of a respective coupling; and a coupling for securing said key stem to said key head;

wherein turning of said key imparts rotational movement to said inner sleeve by meshing cooperation of said first teeth of said pivot and said second teeth of said short tube for bringing said key stem to a first position in which said tumbler pins are moved to the respective shear line to open the lock, and for bringing said key stem to a second position in which said tumbler pins are moved to preclude opening of said lock.

2. The lock according to claim 1, wherein said keyhole formation of said pivot is eccentrically positioned with respect to the major longitudinal axis of said pivot.

* * * * *